US005293666A

United States Patent [19]

Armstrong

[11] Patent Number: 5,293,666

[45] Date of Patent: Mar. 15, 1994

[54] DELAYED ACTION DOOR HOLDER

[76] Inventor: Richard W. Armstrong, Star Rte. Box 44A, Swansboro, N.C. 28584

[21] Appl. No.: 952,662

[22] Filed: Sep. 28, 1992

[51] Int. Cl.[5] ..... E05F 3/00

[52] U.S. Cl. ..... 16/66; 16/84

[58] Field of Search ..... 16/66, 63, 65, 70, 84, 16/86 A, 86 R, 85; 292/341.12; 248/205.5, 205.7, 205.8, 205.9, 206.2, 206.3

[56] References Cited

U.S. PATENT DOCUMENTS

| | | | |
|---|---|---|---|
| 478,371 | 7/1892 | Shaw | 16/84 |
| 478,372 | 7/1892 | Shaw | 16/84 |
| 478,388 | 7/1892 | Wright | 16/84 |
| 1,175,548 | 11/1914 | Bouchery | 248/205.7 |
| 1,621,974 | 3/1927 | Deenihan | 16/84 |
| 1,834,163 | 12/1931 | Lasier et al. . | |
| 2,117,013 | 5/1938 | Bernhard . | |
| 2,522,252 | 9/1950 | Billeter . | |
| 2,585,413 | 2/1952 | Simpson | 16/66 |
| 2,964,779 | 12/1960 | Gohr . | |
| 3,016,563 | 1/1962 | de Jong . | |
| 3,042,958 | 7/1962 | Spears . | |
| 3,212,122 | 10/1965 | Flint . | |
| 3,562,850 | 2/1971 | Eliason et al. . | |
| 3,863,568 | 2/1975 | Frederick | 248/205.8 |
| 3,909,877 | 10/1975 | Christy et al. . | |
| 4,053,961 | 10/1977 | Wilson et al. . | |
| 4,483,044 | 11/1984 | Johnston et al. | 16/70 |
| 4,505,502 | 3/1985 | Tomita . | |
| 4,506,407 | 3/1985 | Downey . | |
| 4,536,916 | 8/1985 | Storandt et al. . | |
| 4,759,099 | 7/1988 | Morano et al. | 16/64 |

*Primary Examiner*—Paula A. Bradley
*Assistant Examiner*—Chuck Y. Mah
*Attorney, Agent, or Firm*—John T. Whelan

[57] ABSTRACT

Apparatus including a suction mechanism for holding open a door or similar member for a predetermined time period, whereupon the door is automatically released and is able to return to its closed position. The period of time during which the suction mechanism is active may be determined by means of an adjustable air leakage to the suction mechanism. The entire mechanism is attached to the inner surface of the door and the necessary relative motion of parts achieved by a connecting rod attached to the adjacent door jam. Spring or equivalent means are provided to protect the door and apparatus against overload by accidental movement of the door when firmly held open.

19 Claims, 6 Drawing Sheets

DELAYED ACTION DOOR HOLDER

BACKGROUND AND OBJECT OF THE INVENTION

The present invention relates generally to an apparatus for holding a door or similar member in an open position for a predetermined period of time after which the door is returned to a closed position, and specifically relates to a pneumatic delayed action door holder.

A simple and inexpensive yet effective delayed action door holder has tremendous applications in both commercial and residential settings. For example, stores or other businesses may equip doors through which stock or merchandise regularly passes with such a holder in order to better accommodate its personnel by allowing the doors to remain open for an extended period, yet maintaining security by allowing the door to be closed after the goods have passed. Doors through which streams of people pass, such as those in churches, schools, or hospitals may also greatly benefit from such an apparatus. In addition, private residences, especially those in which an elderly or disabled person lives, may use such a device to allow that person the extra time necessary to safely pass through a doorway.

Means for delaying the closure of a door or the like have been attempted in the past. For example, U.S. Pat. No. 4,053,961 discloses the use of a suction pad which is attached to a door and which mates with a predetermined portion of the surface of an adjacent wall when the door is opened. The suction pad is caused to leak, either by holes provided in the pad itself o holes in that portion of the wall mating with the pad, thus eventually breaking the suction and allowing the door to close. Other attempts have been made for a suction cup provided on a door to temporarily mate with a second suction cup positioned on the wall, such as is described in U.S. Pat. No. 3,042,958. Such prior art however, suffers from distinct disadvantages since the suction pad must be adapted for attachment directly to the wall or to a mating member positioned on the wall, thus causing not only damage to the wall through the installation and continuous use of the device, but also requiring precise positioning of the suction pad relative to that portion of the wall with which it mates.

Still other prior art apparatus require extensive gearing, hydraulic cylinders, pistons, or the like to delay the closing of a door. However, the complexity and expense of these devices render them impractical in many applications.

Accordingly, it is an object of the present invention to provide an apparatus for holding open a door or similar member for a predetermined period of time after which the door is returned to its closed position. It is a further object of the present invention to provide a delayed action door holder which is simple and inexpensive in construction. It is a still further object of the present invention to provide a delayed action door holder in which the means for achieving the delay in the closing the door does not require the relative positioning of elements provided on the door and elements positioned on the wall adjacent the door.

To achieve the above and other objects and in accordance with the purpose of the present invention, as embodied and broadly described herein, the invention comprises a combination of elements including, for example, a suction pad mounted to the door; a plate mounted to the door; means for providing relative motion between the suction pad and the plate as the door is moved to a predetermined position, the plate contacting the suction pad to form a vacuum therebetween when the door or other similar member reaches the predetermined position, the vacuum retaining the door in the predetermined position; and means for controlling the duration of the vacuum.

Because the apparatus of the present invention readily mounts on the jam of a door, it is particularly useful for storm or screen doors which must be held open by the person entering the door while a second door is opened.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

BRIEF DESCRIPTION OF THE DRAWINGS

The invention will now be described with reference to the accompanying drawings, wherein.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
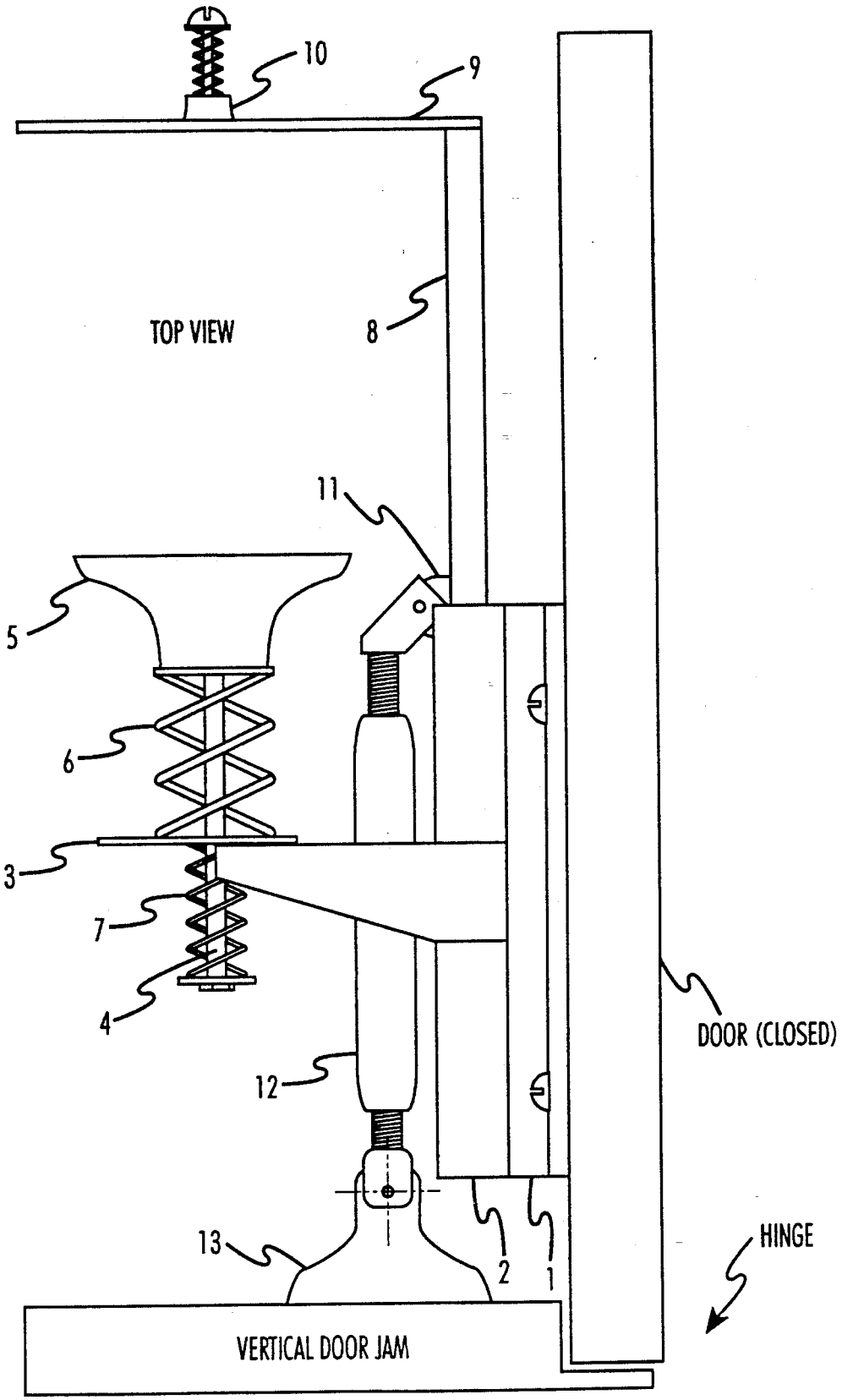
FIG. 1 is a top view of a first preferred embodiment of the present invention with the door closed.
Figure 1A:
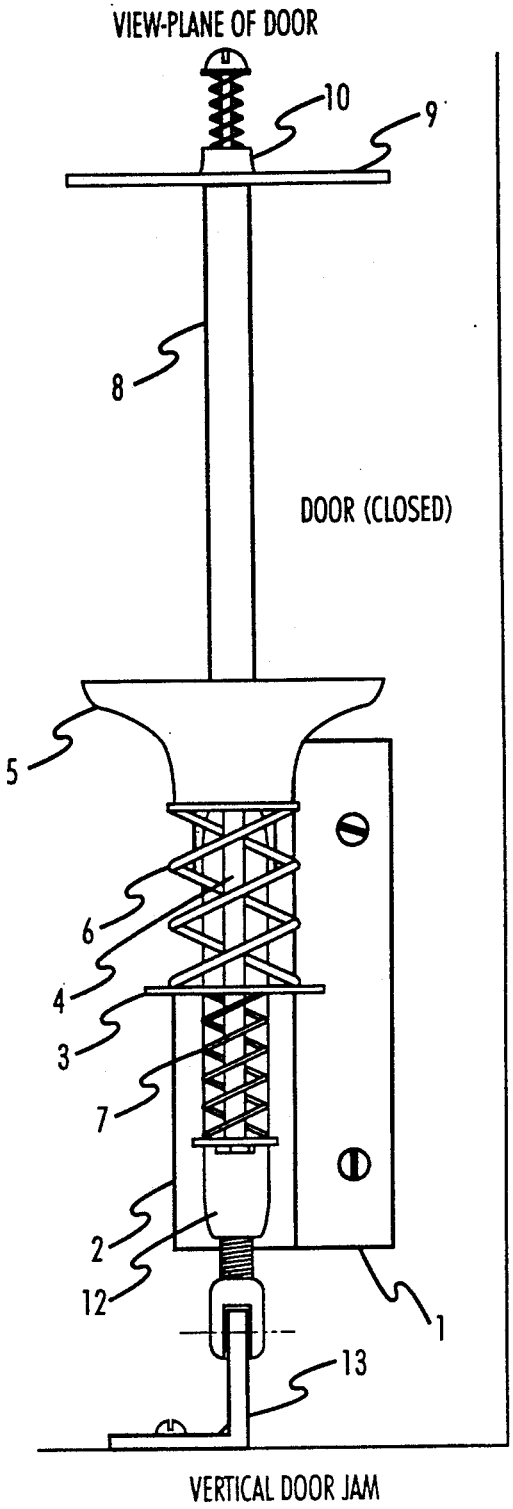
FIG. 1*a* is front or perpendicular to the door view of the first preferred embodiment of the present invention with the door closed.

Referring to FIGS. 1 and 1*a*, an offset mount 1 made of metal or other suitable rigid material is fixedly attached to a door. A guide member 2 which may be reversed in direction to accommodate doors hinged right or left handed is fixedly secured to the mount 1. A vertical plate 3, integrated with the guide member 2, extends from guide member 2 and is provided with a hole having a predetermined diameter centrally located therein. The hole in plate 3 supports and locates a rod 4 having an outer diameter less than the diameter of the hole in plate 3. The rod 4 is thus free to slide through the hole. A first end of the rod 4 is rigidly attached to a suction pad 5 or other similar material made of rubber or the like. Suction pad 5 is spatially separated from the plate 3 by a first spring 6 surrounding rod 4. On the opposite side of plate 3, a second spring 7 surrounds rod 4 and is held in contact with plate 3 by a fixture such as an adjustable wing nut or the like provided on the other end of rod 4. The wing nut may be tightened to vary the onset or degree of damping.

A slide 8 is slidably positioned in guide member 2. Slide 8 is rigidly attached to a plate 9 which contains a vacuum relief valve 10. A projection 11 is positioned on slide 8 to provide, through a length adjusting pivoting connecting rod 12, for slide 8 to be attached to a door jam bracket 13.

Figure 2:
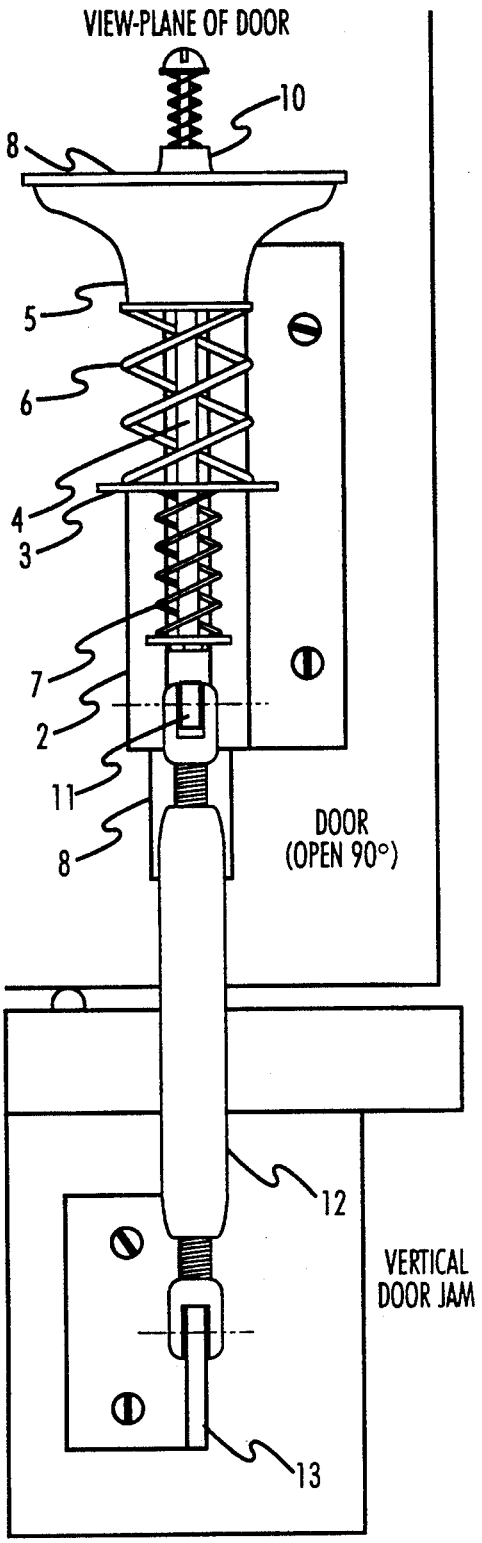
FIG. 2 is a front or perpendicular to the door view of the first preferred embodiment the present invention, with the door open.

Referring to FIG. 2, when the door is opened connecting rod 12 pivots on jam bracket 13 and pulls plate 9 into contact with suction pad 5. The relative motion between plate 9 and suction pad 5 occurs since the door to which mount 1 and suction pad 5 are secured pivots on hinges which have a different axis of rotation than the axis of rod 12. The suction pad 5 secures itself to plate 9 upon contact therewith, a vacuum being formed in a cavity defined by suction pad 5 and plate 9. The vacuum sealing suction pad 5 to plate 9 prevents further relative motion between the two elements, thus maintaining the door in an open position.

Vacuum relief valve 10 comprises an adjustable set screw, valve, or the like and covers an aperture provided in plate 9. Vacuum relief valve 10 may be adjusted to allow air to pass through the aperture provided in plate 9 into the area sealed by suction pad 5 at varying rates. As the air passes through vacuum relief valve 10 and plate 9 into the vacuum pad 5, the vacuum pad 5 releases its hold on plate 9 which then allows the door to be closed by the force of a conventional door closer or other spring device (not shown) provided on the door.

Of course, vacuum relief valve 10 may be adjusted to vary the rate at which air passes through the aperture in plate 9 into suction pad 5, thus allowing the time which the vacuum is maintained and therefore the time which the door remains in the open or other predetermined position to be adjusted. If vacuum relief valve 10 is fully closed, no air may pass through the aperture in plate 9 and thus the vacuum between suction pad 5 and plate 9 holding the door in the open position may be maintained indefinitely. Alternatively, if vacuum relief valve 10 is fully opened, the vacuum sealing suction pad 5 to plate 9 will quickly dissipate, and thus the door will simply close at the rate determined by the conventional door closer or spring device mentioned above.

When the door is opened and the suction pad 5 collapses upon contact with plate 9, first spring 6 compresses, thus providing dampening means for preventing an abrupt or rigid stop of the opening door and reducing the likelihood of damage to the door or apparatus. Likewise, if the door is forced by the wind or other outside agent in the closing direction, second spring 7 compresses and thus comprises second dampening means for absorbing the energy to prevent damage to the door or apparatus. Alternatively, an elastomeric material, such as one or more cushioning members such as rubber stoppers or the like slidably mounted on rod 4, may be substituted for or used in combination with first and second springs 6 and 7 to absorb damaging forces imposed on the door.

As mentioned above, the wing nut or the like provided on rod 4 may be adjusted to vary the onset or degree of damping of first and second springs 6 and 7. The position at which the door is held open, that is, the definition of the hold position, may be adjusted by suitably selecting the relative distance between the suction pad 5 and the door jam bracket 13. This may be accomplished by means of adjustable connection rod 12 or other suitable means.

Figure 3:
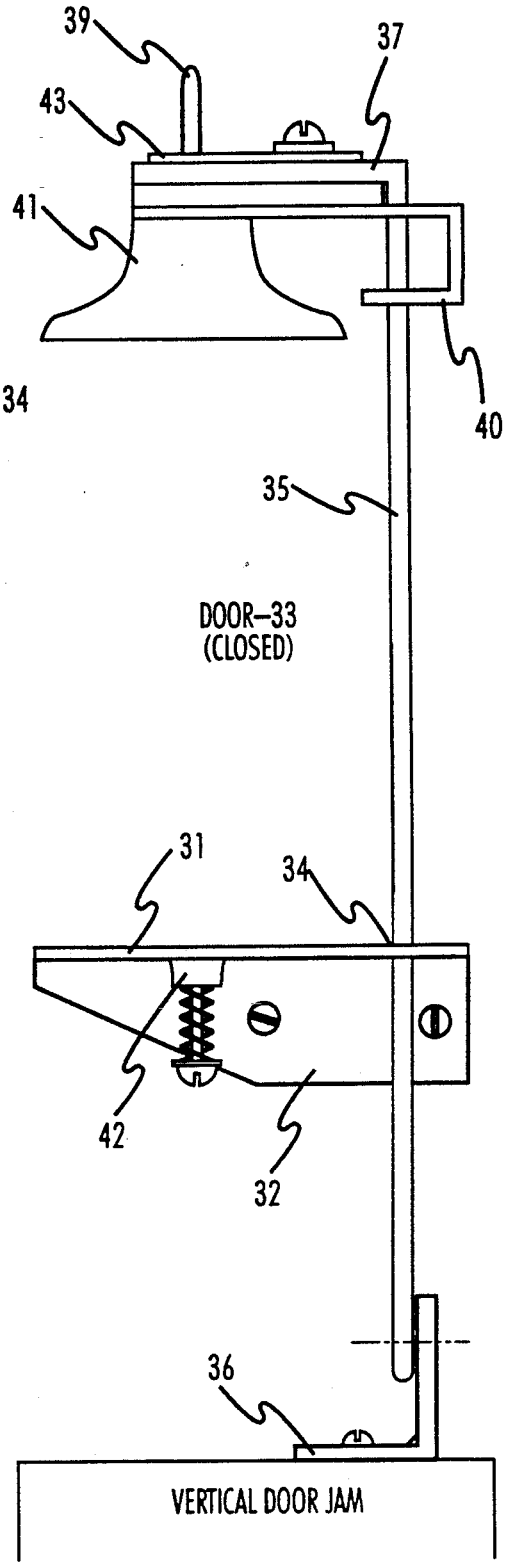
FIG. 3 is a front or perpendicular to the door view of a second preferred embodiment of the present invention with the door closed.
Figure 3A:
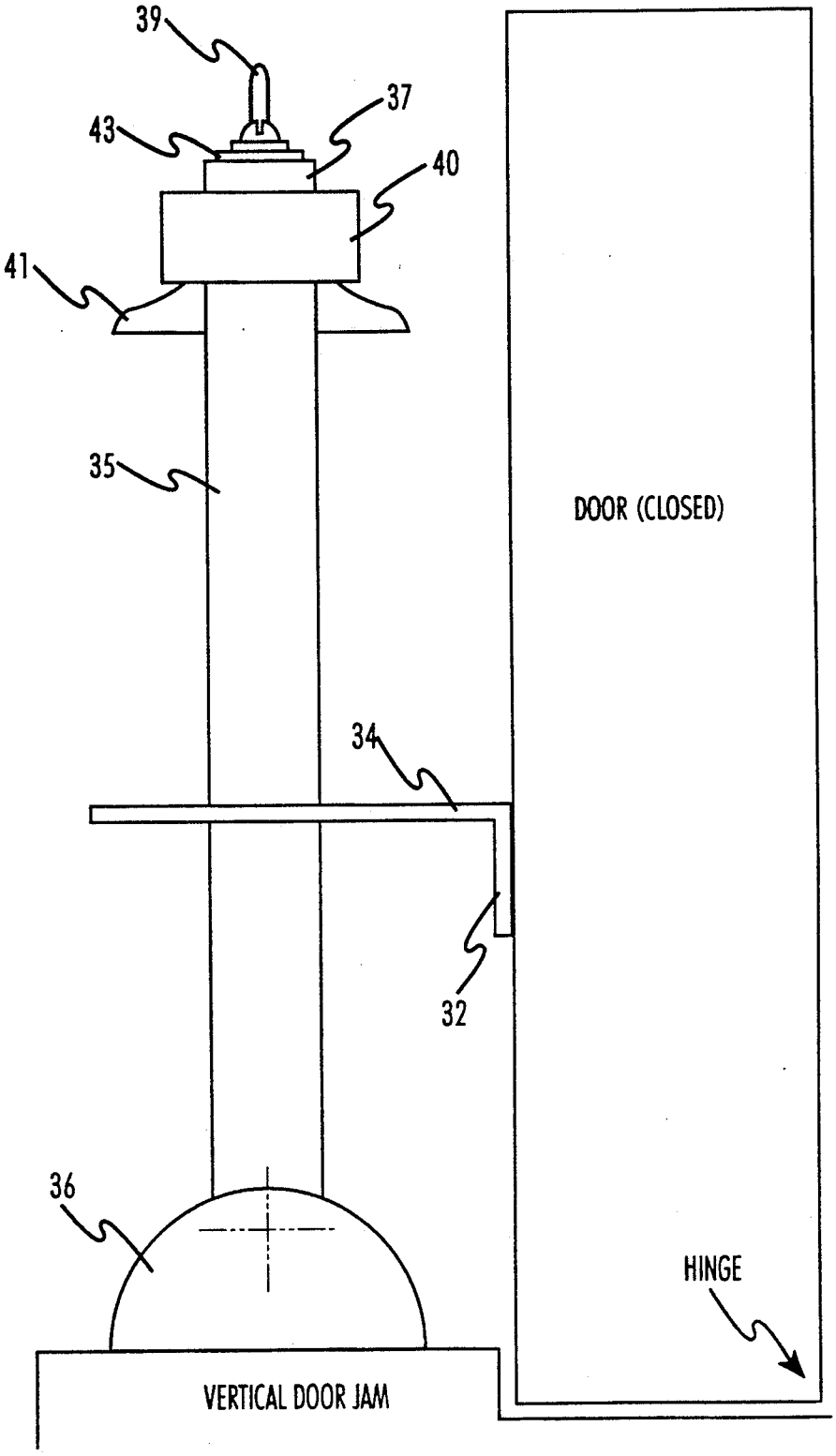
FIG. 3*a* is top view of the second preferred embodiment of the present invention with the door closed.

A second preferred embodiment of the present invention will now be described with reference to FIGS. 3 through 6. Referring to FIG. 3, a plate 31 is provided with an integral mounting bracket 32 which is fixedly attached to a door 33. Plate 31 incorporates a slot 34 configured and positioned to receive a slide arm 35. A first end of slide arm 35 is pivotally attached to a door jam bracket 36. On a second end of the slide arm 35 is provided an integral bracket 37 extending therefrom. Bracket 37 is provided with an aperture therein positioned and configured to slidably receive a rod 39. Rod 39 is rigidly secured to a slide member 40 and to a suction pad 41. Slide member 40 is provided with one or more slots configured and positioned such that slide member 40 and suction pad 41 secured thereto are slidably supported by slide arm 35.

Figure 4:
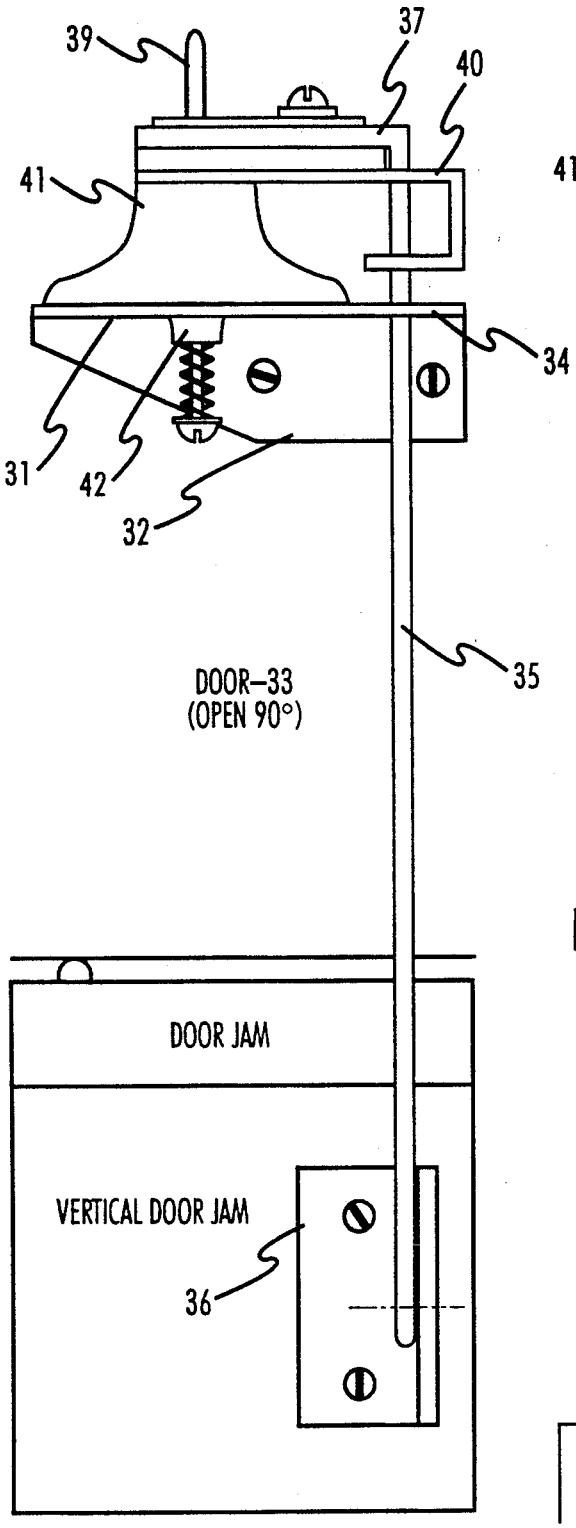
FIG. 4 is a front or perpendicular to the door view of the second preferred embodiment of the present invention with the door open.

As illustrated in FIG. 4, when the door is opened slide arm 35 pivots on jam bracket 36 to pull suction pad 41 into contact with plate 31. The relative motion between suction pad 41 and plate 31 occurs since the door to which mounting bracket 32 and plate 31 are attached pivots about hinges provided o the door which have a different axis of rotation than the axis of the slide arm 35 relative to the jam bracket 36. The suction pad 41 then secures itself to plate 31 upon contact therewith in the manner discussed above in connection with the embodiment illustrated in FIGS. 1 and 2. The vacuum created between suction pad 41 and plate 31 prevents further motion between the two elements, thus maintaining the door in a predetermined position. Adjustable vacuum relief valve 42 in plate 31 may comprise a variable set screw, valve, or other suitable means for adjustably controlling the flow of air through an aperture provided in plate 31. By controlling the flow of air into the cavity defined by vacuum pad 41 and plate 31, the apparatus of the present invention controls the length of time door 33 remains in the predetermined position. As the vacuum in vacuum pad 41 dissipates, the door 33 is closed by the spring force of a conventional door closer or the like (not shown) on the door.

The position at which the door 33 is held open, that is, the definition of the hold position, may be adjusted in the second embodiment by suitably selecting the relative distance between the position at which the mounting bracket 32 is secured to door 33 and the position at which the slide arm is pivotally mounted to jam bracket 36.

Figure 5:
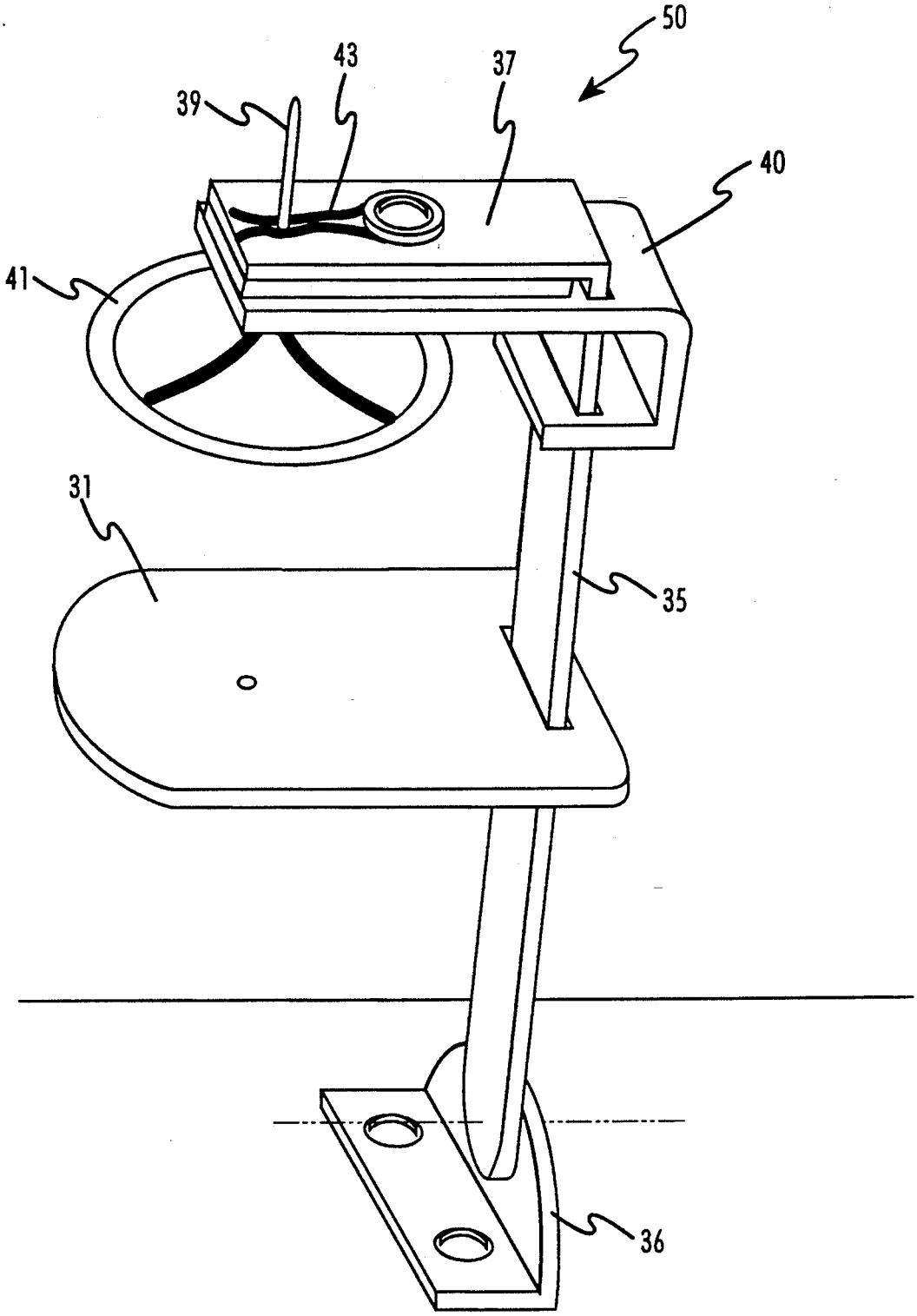
FIG. 5 is a view of a preferred detent mechanism for securing the suction pad to the slide of the embodiment illustrated in FIGS. 3 and 4.
Figure 6:
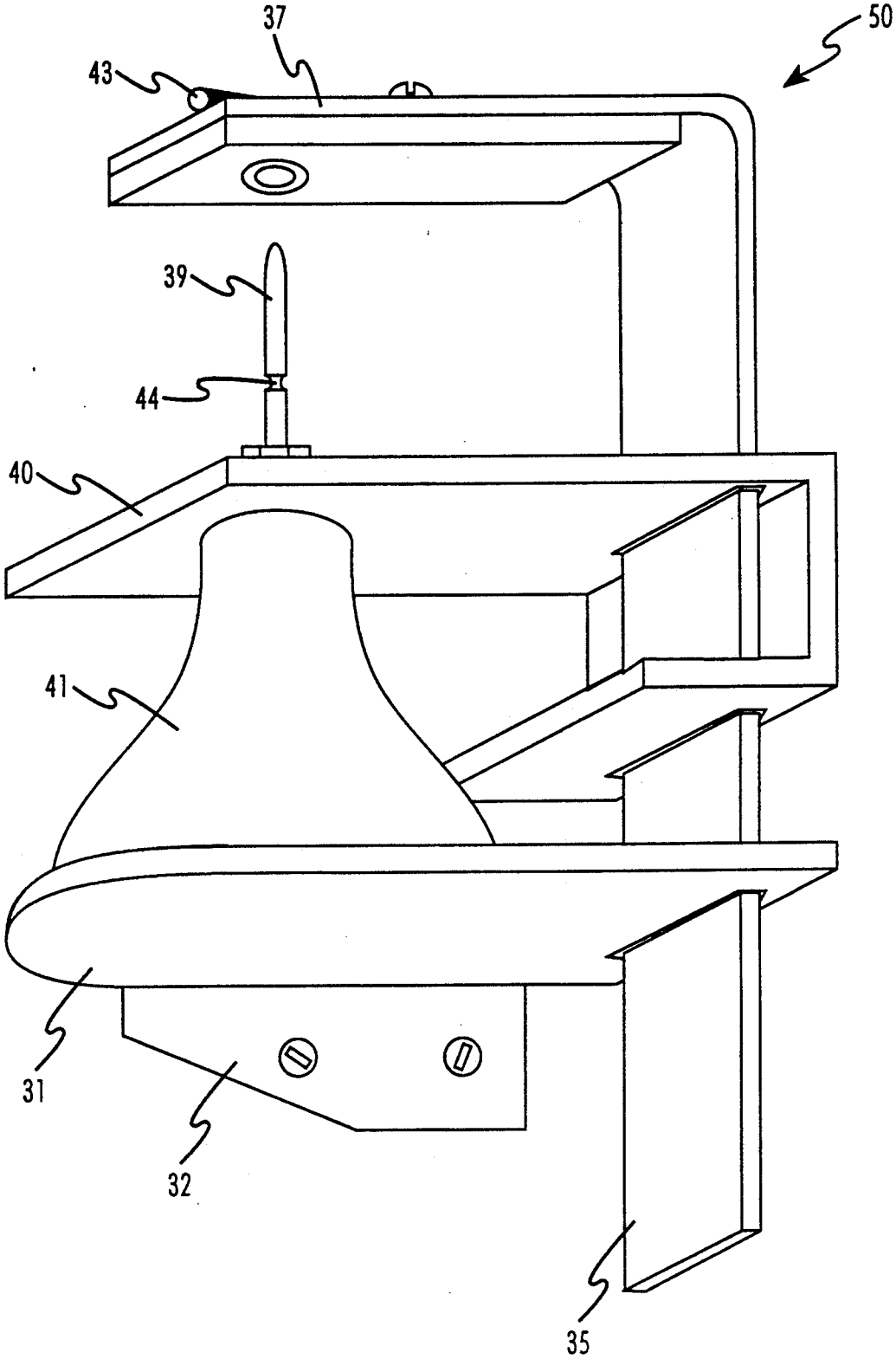
FIG. 6 is a view of the preferred detent mechanism of FIG. 5 with the suction pad released from the detent mechanism.

When the door 33 is opened sufficiently to collapse the suction pad 41 against plate 31, a vacuum is created and door 33 is rigidly held open, as controlled by the setting of vacuum relief valve 42. To prevent a gust of wind or other undesired force from pushing the door closed and thus possibly damaging the door or apparatus, or if it is simply desired to close the door before relief valve 42 has allowed a sufficient amount of air through the aperture in plate 31 to release the vacuum, override means are provided so that the door will close. More particularly, according to the present invention a force releasing detent 50, illustrated in FIG. 5, is provided. The detent 50 consists of a hitch pin 43, secured to bracket 37. A clamping portion of hitch pin 43 fits in a calibrated groove 44 provided at a predetermined position in rod 39, as shown in FIG. 6. When the closing force sufficiently exceeds the force of the vacuum between plate 31 and suction pad 41 that is normally required to hold the door open, the groove 44 in rod 39 is pulled through the hitch pin 43, thus allowing suction pad 41 attached to slide 40 to stay with plate 31, slide 40 moving along slide arm 35. When the door is next opened to the hold position, the aperture in arm bracket 40 again receives rod 39, which has a tapered end. Hitch pin 43 is then relocked in groove 44.

It will be apparent to those skilled in the art that various modifications and variations can be made in the door holding apparatus of the present invention without departing from the spirit or scope of the invention. For example, the positions of the plate and suction pad could be reversed while providing the same relative mechanical action. Alternatively, the suction pad and plate could be replaced by other means for forming and maintaining a suitable vacuum. Moreover, the plate can be fixed to the door and the suction pad movable relative to the plate or vice versa. Further, the vacuum formed between the plate and the suction pad could also be controlled by a vacuum relief valve controlling the flow of air through a aperture provided in the suction pad instead of the plate. Further, various other detent means may be provided such as a spring loaded ball in a groove to serve as an overload device.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What I claim is:

1. An apparatus for retaining a member in a fixed position for a predetermined period of time, said apparatus comprising:

a suction pad mounted on said member;

a plate mounted on said member;

means for providing relative motion between said suction pad and said plate as said member is moved to said fixed position, said plate contacting said suction pad to form a vacuum therebetween when the member reaches said fixed position, said vacuum retaining the member in the fixed position;

means for controlling the duration of said vacuum.

2. An apparatus according to claim 1, wherein said vacuum controlling means comprises an adjustable set screw for controlling the flow of air through an aperture provided in said plate.

3. An apparatus according to claim 1, wherein said vacuum controlling means comprises an adjustable set screw for controlling the flow of air through an aperture provided in said suction pad.

4. An apparatus according to claim 1, wherein said vacuum controlling means comprises a variable valve for controlling the flow of air through an aperture provided in said plate.

5. An apparatus according to claim 1, wherein said vacuum controlling means comprises a variable valve for controlling the flow of air through an aperture provided in said suction pad.

6. An apparatus according to claim 1, further comprising first dampening means for cushioning the impact of the member as the suction pad and plate contact one another.

7. An apparatus according to claim 6, wherein said first dampening means comprises a spring.

8. An apparatus according to claim 6, wherein said first dampening means comprises at least one cushioning member.

9. An apparatus according to claim 6, further comprising means for adjusting the cushioning of said first dampening means.

10. An apparatus according to claim 1, further comprising second dampening means for cushioning the impact if the member is forced in a closing direction against the retention of the vacuum formed between said suction pad and plate.

11. An apparatus according to claim 10, wherein said second dampening means comprises a spring.

12. An apparatus according to claim 10, wherein said second dampening means comprises at least one cushioning member.

13. An apparatus according to claim 10, further comprising means for adjusting the cushioning of said second dampening means.

14. An apparatus according to claim 1, further comprising means for selectively defining said fixed position.

15. An apparatus according to claim 14, wherein said position defining means comprises an adjustable connecting rod.

16. An apparatus according to claim 1, wherein the means for providing relative motion between the suction pad and the plate comprises an arm connected to said suction pad, said arm being slidably connected to a guide member connected to said plate.

17. An apparatus according to claim 16, wherein said suction pad is provided with a rod extending therefrom, said rod being slidably secured by an aperture provided in said guide member to maintain the relative positions of said arm and said guide member.

18. An apparatus according to claim 17, further comprising override means for releasing said member when the member is subject to a closing force greater than that force which is required to hold the closure member in said fixed position.

19. An apparatus according to claim 18, wherein said override means comprises a hitch pin coupled to said guide member and adapted for mating with a groove provided at a predetermined position on said rod extending from said suction pad.

* * * * *